US005997177A

United States Patent [19]

Kaufman

[11] Patent Number: 5,997,177

[45] Date of Patent: Dec. 7, 1999

[54] TAMPER-EVIDENT OPENING SYSTEM FOR BEVERAGE CONTAINER

[75] Inventor: Richard H. Kaufman, New Castle, N.Y.

[73] Assignee: Kraft Foods, Inc., Northfield, Ill.

[21] Appl. No.: 08/977,991

[22] Filed: Nov. 25, 1997

[51] Int. Cl.[6] ..... B65D 33/14

[52] U.S. Cl. ..... 383/5; 383/66; 383/202; 383/208

[58] Field of Search ..... 229/103.1, 204; 383/5, 202, 208, 66; 215/229

[56] References Cited

U.S. PATENT DOCUMENTS

| | | | |
|---|---|---|---|
| 3,272,424 | 9/1966 | Rodkey | 383/208 |
| 3,453,661 | 7/1969 | Repko | 383/66 X |
| 3,596,829 | 8/1971 | Gardner | 229/103.1 |
| 3,687,358 | 8/1972 | Wink et al. | 383/208 |
| 3,711,011 | 1/1973 | Kugler | 383/66 X |
| 4,072,233 | 2/1978 | Kramer et al. | 383/202 |
| 4,092,817 | 6/1978 | Rist, III | 220/709 X |
| 4,429,828 | 2/1984 | Färber . | |
| 4,553,693 | 11/1985 | Terajima et al. . | |
| 4,762,514 | 8/1988 | Yoshida . | |
| 5,054,684 | 10/1991 | Färber et al. . | |
| 5,201,459 | 4/1993 | Bettle, Jr. et al. . | |
| 5,425,583 | 6/1995 | Wild . | |

*Primary Examiner*—Stephen K. Cronin
*Assistant Examiner*—Robin A Hylton
*Attorney, Agent, or Firm*—Thomas R. Savoie; Thomas A. Marcoux

[57] ABSTRACT

An easy-open and tamper-evident beverage container and opening system for the beverage container are provided which include a container barrier wall. The barrier wall has a series of slits therein which define a pierceable straw hole. The series of slits divides the barrier wall into a hole portion and a remainder portion, with the hole portion connected to the remainder portion by attachment points provided between adjacent slits of the series. A membrane seal is located inside of the container and sealingly covers the straw hole. This membrane seal is liquid impervious and includes (a) an outer portion which is sealed to an inside surface of the front barrier wall about the straw hole, and (b) an inner portion integral with the outer portion which is not sealed to the inside surface of the barrier wall and which covers the straw hole. With this construction, when piercing the container with the straw, the straw breaks at least some of the attachment points as the straw pushes on the hole portion and as the straw then easily pierces the membrane seal. The breakage of the attachment points thus provides readily observable and unrepairable evidence of opening of the straw hole. Preferably, the series of slits form a circular str

1 Claim, 1 Drawing Sheet

TAMPER-EVIDENT OPENING SYSTEM FOR BEVERAGE CONTAINER

FIELD OF THE INVENTION

The present invention relates generally to beverage containers which have an opening through which the beverage is consumed through a straw, and more particular to a bag-shaped beverage container having a tamper-evident opening system through which the straw is pierced to access the beverage.

BACKGROUND OF THE INVENTION

In bag-shaped beverage containers having a membrane seal which is to be pierced by a pointed straw, such as CAPRI SUN®, there is a problem of providing a sufficiently strong seal to withstand the rigors of shipping while still making the seal sufficiently easy for the consumer to pierce with a straw. In addition, it is often desired to provide a readily observable indication of whether or not the opening system of the beverage container has been tampered with.

In the prior art, an opening system has been used which includes a simple membrane seal on an inside surface of one barrier wall of a bag-shaped container. The membrane seal is sealed up to the edges of the straw hole in the barrier wall near a top of the container. Such a membrane seal is disclosed in U.S. Pat. No. 5,425,583 (Wild). While such a membrane seal is mostly satisfactory, it does not provide evidence of tampering as the membrane seal can be easily ruptured. The problem of tamper-evidency would be further exacerbated if the membrane seal did not extend up to the edges of the straw hole such that a pocket is created between the barrier wall and the membrane seal.

Another opening system for a beverage bag having a portion which can be easily pierced by a straw is disclosed in U.S. Pat. No. 4,762,514 (Yoshida). The bag is made from a pair of laminar panels, with each panel comprising an inner foil layer and an outer reinforcing plastic layer bonded over the inner layer. This outer layer has a high piercing strength and high rigidity. In order to make piercing of the outer layer very easy, a number of radially extending linear cuts in the form of a starburst are formed therein. However, no breakage occurs in the outer layer so there is no tamper evidence when this outer layer is pierced.

SUMMARY OF THE INVENTION

In accordance with the present invention, an easy-open and tamper-evident beverage container and in particular an opening system for the beverage container are provided which include a container barrier wall. The barrier wall has a series of slits therein which define a pierceable straw hole. The series of slits divides the barrier wall into a hole portion and a remainder portion, with the hole portion connected to the remainder portion by attachment points provided between adjacent slits of the series. A membrane seal is located inside of the container and sealingly covers the straw hole. This membrane seal is liquid impervious and includes (a) an outer portion which is sealed to an inside surface of the front barrier wall about the straw hole, and (b) an inner portion integral with the outer portion which is not sealed to the inside surface of the barrier wall and which covers the straw hole. With this construction, when piercing the container with the straw, the straw breaks at least some of the attachment points as the straw pushes on the hole portion and as the straw then easily pierces the membrane seal. The breakage of the attachment points thus provides a readily observable and unrepairable evidence of opening of the straw hole. The breakage of the attachment points requires a slight amount of force which is absent if the straw hole has been tampered with. Thus, the absence of resistance to the straw is another indicator of possible tampering.

In a preferred embodiment, the series of slits form a circular straw hole and the membrane seal is circular and centered about the straw hole. As will be appreciated by those skilled in the art, the membrane seal may extend up to the edges of the straw hole, but is more preferably spaced-apart from the edges of the straw hole.

In another preferred embodiment of the present invention an easy-open beverage container is provided which produces an audible sound when the attachment points of the hole portion are broken, so that the absence of such a sound when piercing of the straw hole serves as an indication that the hole portion may have been tampered with.

It is an advantage of the present invention that an easy-open beverage container is provided which is readily pierced with a straw and that this causes breakage of attachment points of the hole portion of the barrier wall so that any prior piercing of the membrane seal by a straw or the like is readily viewed by looking at the broken attachment points, making the opening system tamper-evident.

Other features and advantages of the present invention are stated in or apparent from a detailed description of a presently preferred embodiment of the invention found hereinbelow.

DESCRIPTION OF THE PREFERRED EMBODIMENT

Figure 1:
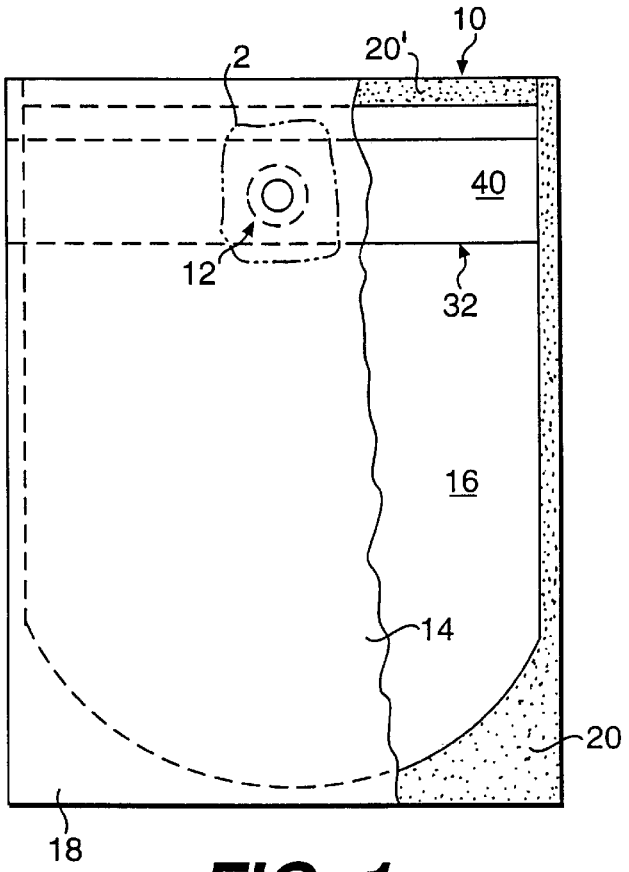
FIG. 1 is a front elevation view of a beverage container of the present invention with a portion of the front wall of the container cut away.

With reference now to the drawings in which like numerals represent like elements throughout the views, an easy-open and tamper-evident beverage container 10 including an opening system 12 according to the present invention is depicted in FIG. 1. Beverage container 10 is an improvement to the beverage containers of this type, and in particular to the opening system disclosed U.S. Pat. No. 5,425,583 noted above which is hereby incorporated by reference. Beverage container 10 includes a first or front barrier wall 14 (partially cut away) having an inside surface 18 and a second or back barrier wall 16. As appreciated by those in the art, barrier walls 14 and 16 are attached together by a suitable adhesive or heat sealed layer 20, depicted by stippling, along the peripheral edges of the two lateral sides and bottom prior to filling. Beverage container 10 is then filled through the open top, and the top edges are then similarly attached together with a similar layer 20'. As also appreciated by those in the art, barrier walls 14 and 16 are suitably formed as a sealing foil, either a mono-layer material or a multi-layer compound material both of which are well known.

Opening system 12 includes a pierceable straw hole 22 punched or otherwise provided near the top of front barrier wall 14 by a series of slits 24. Conveniently, slits 24 can be provided at the known hole punching station for front barrier wall 14 by designing the male punch die with spaced-apart raised sections around the circumference are by designing the female punch die with spaced-apart depressed sections. It will thus be appreciated that slits 24 divide barrier wall 14 into a circular hole portion 26 and a remainder portion, with hole portion 26 remaining connected to the remainder of barrier wall 14 by attachment points 28 provided between adjacent slits 24. Hole portion 26 is provided so that a straw 30 (depicted only in part in FIG. 4), which is typically provided with a filled and sealed beverage container 10, can be easily pushed through straw hole 22 in order for the consumer to suck the beverage from beverage container 10.

Figure 2:
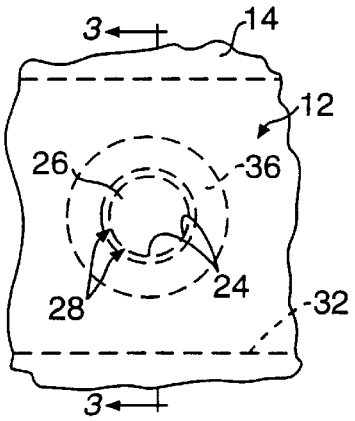
FIG. 2 is an enlarged view of that part of the beverage container including the straw hole circled with a broken line identified with the number 2 in FIG. 1.
Figure 4:
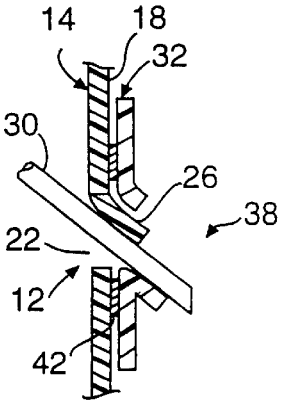
FIG. 4 is a cross-sectional side elevation view of the membrane seal depicted in FIG. 2 after a straw is inserted therethrough.

Some of the attachment points 28 are intended to remain unbroken as the straw is pushed through straw hole 22. Thus as shown in FIG. 4, circular hole portion 26 is partially broken away from the remainder portion of barrier wall 14 and partially attached to this remainder portion. Hole portion 26 is retained with beverage container 10 and does not create litter or a risk of passage into the container. As shown in FIG. 2, attachment points 28 are of equal length and uniformly distributed around the circumference of hole portion 26. It would, of course, be possible to have some attachment points stronger than others, such as by having a greater length, to insure selective breakage and retension of hole portion 26.

In order to cover and seal hole portion 26 (or actually slits 24) prior to use by a consumer, opening system 12 also includes a seal strip 32. As known in the art, seal strip 32 is conveniently attached across the top of beverage container 10 by having the longitudinal ends thereof trapped between the attached edges of the two lateral sides of front barrier wall 14 and back barrier wall 16. Seal strip 32 is composed of three integral sections, an inner portion 34 and an outer portion 36 which together comprise a basic membrane seal 38, and a mounting portion 40 used during the forming of membrane seal 38. Conveniently, seal strip 32 is provided from a continuous reel for attachment to front barrier wall 14.

Figure 3:
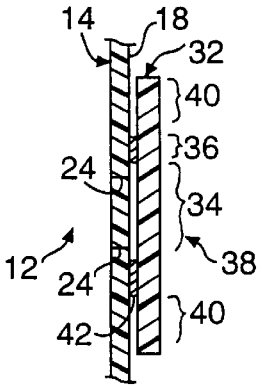
FIG. 3 is an enlarged cross-sectional side elevation view of the portion of the membrane seal depicted in FIG. 2 taken along the line 3—3.

As shown best in FIG. 3, outer portion 36 is suitably attached by a heat seal 42 or otherwise securely attached to inside surface 18 of front barrier wall 14, while neither inner portion 34 nor mounting portion 40 are attached to inside surface 18. It will be particularly noted that straw hole 22 is preferably circular, with inner portion 34 then being centered about the center of straw hole 22 (or slits 24) and outer portion 36 also having an outer circular shape likewise centered about inner portion 34 and hence straw hole 22.

In the preferred embodiment, membrane seal 38 is preferably formed as a laminate of an LLDPE (linear low density polyethylene) layer, an EVOH (ethylene vinyl alcohol) layer, and another LLDPE suitably attached or laminated together as by (optional) tie layers. Preferably, membrane seal 30 has an overall thickness of about 40 microns (0.00157"), with the EVOH layer less than about 40% of the thickness and the LLDPE layers at least 30% each of the thickness (with the thickness of any tie layers being negligible). With this construction, straw 30 is able to pierce membrane seal 38 easily, with inner portion 34 stretching and distending (thinning) before being ruptured by straw 30 as explained in greater detail subsequently.

In practice, it is often difficult to precisely center inner portion 34 on straw hole 22 of front barrier wall 14 when (typically) sealing jaws are used to seal outer portion 36 to inside surface 18. Rather, the position of seal strip 32 and hence of inner portion 34 may differ by about ±2 mm. Therefore, the size of outer portion 36 and hence the position of heat seal 42 should be sufficient to allow for such miscenterings. Within this constraint, it will also be appreciated that the width of seal strip 32 should also be minimized to conserve material. A suitable straw hole diameter for beverage container 10 is 5 mm and a suitable straw diameter for use with such a straw hole is 3.5 mm. With such dimensions, suitable dimensions for opening system 12 further include: width of seal strip 32, 16.5 mm; and diameter of outer portion 36, 13.5 mm.

In use, straw 30 is first pushed against hole portion 26 of front barrier wall 14 of (filled and sealed) beverage container 10 and hence straw 30 immediately also pushes against inner portion 34 of membrane seal 38. Because attachment points 28 are very weak, attachment points 28 readily break or rupture as inner portion 34 readily elongates or distends when first contacted by straw 30. Therefore, as shown in FIG. 4, straw 30 causes at least some of attachment points 28 of hole portion 26 to break or rupture as straw 30 simultaneously pushes through inner portion 34 of membrane seal 38. It will be appreciated that this rupture of attachment points 28 may cause an audible sound which the consumer can hear. Thereafter, straw 30 is guided by straw hole 22 during further entry.

The tamper-evident feature of opening system 12 is provided by the breakage of attachment points 28 as straw 30 is pushed through inner portion 34 of membrane seal 38. If the consumer does not perceive the rupturing of attachment points 28, this will serve as an audible indication there has been some tampering with hole portion 26. In addition, the insertion of straw 30 will also be made with less force if attachment points 28 have already been broken, so that this will serve as another indicator to the consumer that breakage of the attachment points 28 has occurred. Further, such breakage occurs with some stretching at attachment points 28, so it is not possible to replace inner portion 34 back in place without visible evidence at the stretched attachment points 28 that this breakage has occurred. It will thus be appreciated that opening system 12 provides three separate evidences of prior breakage of attachment points 28 and hence of potential tampering with hole portion 26 and/or beverage container 10.

While opening system 12 has been depicted with six slits 24 and hence six attachment points 28, greater or fewer slits 24 or attachment points 28 are possible. In addition, the size of attachment points 28 is also adjustable for greater or lesser holding power and evidence of rupture. Further, while straw 30 has been depicted with the pointed end typically provided lowermost, it will be appreciated that the pointed end could be rotated to any position (such as uppermost) without effecting the operation of opening system 12 described above.

While the present invention has been described with respect to an exemplary embodiment thereof, it will be understood by those of ordinary skill in the art that variations and modifications can be effected within the scope and spirit of the invention.

I claim:

1. An tamper-evident beverage container which is pierced by a straw comprising a back barrier wall; a front barrier wall facing said back barrier wall, said front barrier wall having a series of spaced-apart slits therein which define a pierceable straw hole, said series of slits forming a circular straw hole, said slits dividing said barrier wall into a hole portion and a remainder portion with said hole portion connected to said remainder portion by attachment points provided between adjacent said slits of said series; a membrane seal located inside of the container and sealingly covering the straw hole, said membrane seal being liquid impervious, being circular and centered about the straw holes, having an outer portion which is sealed to an inside surface of said front barrier wall about the straw hole, and having an inner portion integral with said outer portion which is not sealed to the inside surface of said barrier wall and which covers the straw hole so that in piercing of the container with the straw, the straw breaks at least some of said attachment points, said breaking producing an audible sound as the straw pushes on said hole portion and as the straw then pierces said membrane seal, which some of the attachment points remain unbroken whereby, said hole portion is retained with the beverage container; and whereby, said attachment points provide both resistance to the straw as an indicator of tampering and visible evidence of tampering.

* * * * *